US008636607B2

(12) United States Patent
Renna

(10) Patent No.: US 8,636,607 B2
(45) Date of Patent: Jan. 28, 2014

(54) PUTTER HEAD

(76) Inventor: Allesandro Marco Renna, North Vancouver (CA)

( * ) Notice: Subject to any disclaimer, the term of this patent is extended or adjusted under 35 U.S.C. 154(b) by 191 days.

(21) Appl. No.: 12/457,968

(22) Filed: Jun. 26, 2009

(65) Prior Publication Data

US 2010/0331104 A1 Dec. 30, 2010

(51) Int. Cl.
*A63B 53/04* (2006.01)

(52) U.S. Cl.
USPC ..... 473/340

(58) Field of Classification Search
USPC ..... 473/340
See application file for complete search history.

(56) References Cited

U.S. PATENT DOCUMENTS

| | | | | |
|---|---|---|---|---|
| 4,964,641 | A | 10/1990 | Miesch et al. | |
| 5,029,864 | A | 7/1991 | Keener | |
| 5,253,869 | A | 10/1993 | Dingle et al. | |
| 5,437,447 | A * | 8/1995 | Rigutto | 473/251 |
| 5,618,239 | A | 4/1997 | Rife | |
| 5,637,044 | A | 6/1997 | Swash | |
| 5,709,616 | A | 1/1998 | Rife | |
| 5,921,871 | A * | 7/1999 | Fisher | 473/329 |
| 6,007,434 | A | 12/1999 | Baker et al. | |
| 6,019,686 | A | 2/2000 | Gray | |
| 6,110,057 | A | 8/2000 | McKinnon | |
| 6,183,379 | B1 | 2/2001 | Kim et al. | |
| 6,224,496 | B1 | 5/2001 | Rowland et al. | |
| 6,743,117 | B2 | 6/2004 | Gilbert | |
| 6,749,523 | B1 | 6/2004 | Forzano | |
| 6,849,004 | B2 | 2/2005 | Lindsay | |
| 6,863,620 | B2 * | 3/2005 | Tucker, Sr. | 473/288 |
| 7,018,304 | B2 | 3/2006 | Bradford | |
| 7,134,971 | B2 | 11/2006 | Franklin et al. | |
| 7,297,073 | B2 | 11/2007 | Jung | |
| 7,341,527 | B1 * | 3/2008 | Fisher | 473/329 |
| 7,452,283 | B2 | 11/2008 | Hettinger et al. | |
| 7,510,484 | B2 | 3/2009 | Tavares et al. | |
| 7,806,779 | B2 * | 10/2010 | Franklin et al. | 473/251 |
| 2002/0032075 | A1 | 3/2002 | Vatsvog | |
| 2006/0223649 | A1 | 10/2006 | Rife | |
| 2007/0184915 | A1 * | 8/2007 | Mansfield | 473/340 |

FOREIGN PATENT DOCUMENTS

| | | |
|---|---|---|
| CA | 2146717 | 10/1996 |
| GB | 181443 | 6/1922 |

* cited by examiner

*Primary Examiner* — Michael Dennis
(74) *Attorney, Agent, or Firm* — Richard Okimaw

(57) ABSTRACT

Disclosed is a putter head and a putter having the putter head comprising a putter head body having a putter shaft connector and least one horizontal bore extending therethrough and a locatable adjacent to the putter head body. The impact adjustment body has at least one bore alignable with the bore in the putter head body. The putter head further comprises a putter face plate locatable adjacent to the impact adjustment body such that the impact adjustment body is disposed between the putter face plate and the putter head body and at least one weighted fastener sized to extend through the bores in the putter head body and the impact adjustment body so as to secure the putter face plate to the putter head body. Also disclosed is a kit for constructing an adjustable putter head including a plurality of interchangeable impact adjustment bodies and weighted fasteners.

19 Claims, 7 Drawing Sheets

PUTTER HEAD

BACKGROUND OF THE INVENTION

1. Field of Invention

The present invention relates to golf putters in general and in particular to a putter head having adjustable balance and feel.

2. Description of Related Art

Golf is a popular game played by players of all ages, genders and skill levels. Many golfers continuously attempt to improve their performance through practice, lessons or better equipment. Golf equipment manufacturers in turn continuously improve the quality of the equipment they offer as well as seek the latest advances which they can offer their customers.

Putters are a type of golf club used for hitting the ball when close to the cup when on the putting green. Putters are typically designed to provide the user with a consistent swing or stroke and to make contact with the ball in a manner that provides a sufficient amount of information to the user about the swing. The information transmitted to the golfer, or feel, may be the resistance provided by the ball, vibration through the club from the ball impact or the sound made by the club among other types of information.

As many golfers have different skill abilities and swing characteristics, no single putter is typically the best suited for all players. Differences in rebound preference to swing angle and trajectory are all typically different. Current putters exist enabling the user to modify some aspects of the club such as the weight distribution in the club head or the properties of the striking surface. Such clubs however are limited to modifying single aspects of the putter performance.

SUMMARY OF THE INVENTION

According to a first embodiment of the present invention there is disclosed a putter head comprising a putter head body having a putter shaft connector and least one horizontal bore extending therethrough and an impact adjustment body locatable adjacent to the putter head body. The impact adjustment body has at least one impact adjustment body bore alignable with the at least one putter head body bore. The putter head further comprises a putter face plate locatable adjacent to the impact adjustment body such that the impact adjustment body is disposed between the putter face plate and the putter head body and at least one weighted fastener sized to extend through the putter head body bore and the impact adjustment body bore so as to secure the putter face plate to the putter head body.

The putter face plate fastener may include at least one fastener receptacle alignable with the at least one impact adjustment body bore and the at least one putter head body bore wherein the fastener is engageable within the fastener receptacle to secure the impact adjustment body and the putter face plate to the putter head body. The putter face plate may include at least one post extending therefrom sized to extend through the putter head body bore and the impact adjustment body bore wherein the fastener is securable to an end of the post.

The putter head body may comprise a heal portion and a toe portion and a longitudinal length extending therebetween, wherein the heal portion includes a first putter head body bore and the toe portion includes a second parallel putter head body bore. The impact adjustment body may comprise a planar member having an outline corresponding to the putter face plate. The impact adjustment body may be domed towards the putter face plate. The at least one fastener may have a weighted head having one of a plurality of predetermined weights.

The putter face plate may include a ball striking surface. The ball striking surface may be substantially planar. The ball striking surface may be substantially perpendicular to the putter body bores and the impact adjustment body bores.

The ball striking surface may have a surface pattern therein. The surface pattern may include a first surface pattern and a second surface pattern. The ball striking surface may include the first surface pattern across a central portion thereof and said second surface pattern adjacent to heal and said toe portions. The first surface pattern may comprise a plurality of parallel substantially horizontal grooves. The second surface pattern may comprise a plurality of parallel grooves angularly extending from central portion upwardly towards the respective heal or toe portion. The angular groves of the second surface pattern may be inclined at an angle of between 60 and 80 degrees from horizontal. The first surface pattern may comprises a plurality of parallel substantially horizontal slots through the putter face plate.

According to a further embodiment of the present invention there is disclosed a putter having a putter head body having a putter shaft connector and least one horizontal bore extending therethrough and an impact adjustment body locatable adjacent to the putter head body. The impact adjustment body has at least one impact adjustment body bore alignable with the at least one putter head body bore. The putter head further comprises a putter face plate locatable adjacent to the impact adjustment body such that the impact adjustment body is disposed between the putter face plate and the putter head body and at least one weighted fastener sized to extend through the putter head body bore and the impact adjustment body bore so as to secure the putter face plate to the putter head body.

According to a further embodiment of the present invention there is disclosed a kit for constructing an adjustable putter head comprising a putter head body having at putter shaft connector and least one horizontal bore extending therethrough and a plurality of interchangeable impact adjustment bodies locatable adjacent to the putter head body. Each of the plurality of impact adjustment bodies has at least one impact adjustment body bore alignable with the at least one putter head body bore. The kit further comprises a putter face plate locatable adjacent to at least one of the plurality of impact adjustment bodies such that the at least one of the plurality of the impact adjustment bodies is disposed between the putter face plate and the putter head body and a plurality of weighted fasteners sized to extend through the at least one putter head body bore and the at least one impact adjustment body bore so as to secure the impact adjustment body and the putter face plate to the putter head body. The plurality of weighted fasteners have unique predetermined masses for adjusting the swing characteristics of the putter head.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
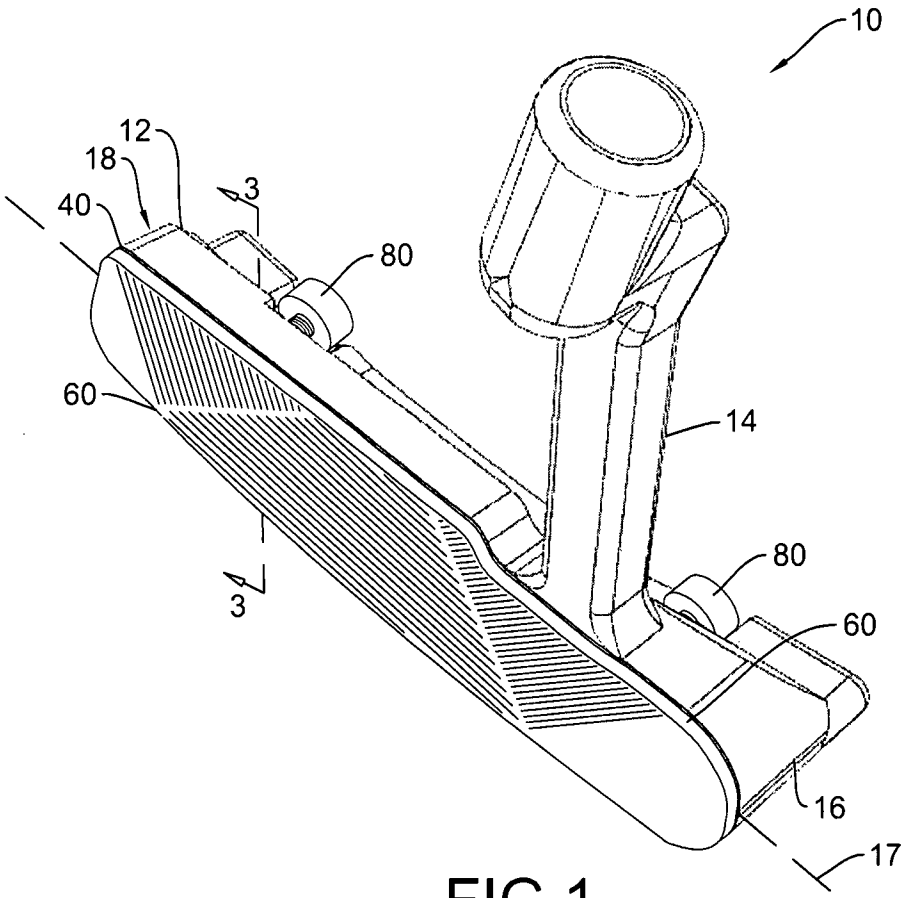
FIG. 1 is a perspective view of a putter head according to a first embodiment.

Referring to FIG. 1, a putter head according to a first embodiment of the invention is shown generally at 10. The putter head 10 comprises a putter head body 12 having a putter shaft connector or hosel 14 extending therefrom as are known in the art. The putter head 10 also includes a putter face plate 60 and an insert (not shown in FIG. 1) secured thereto by fasteners 80 as will be further described below.

Figure 2:
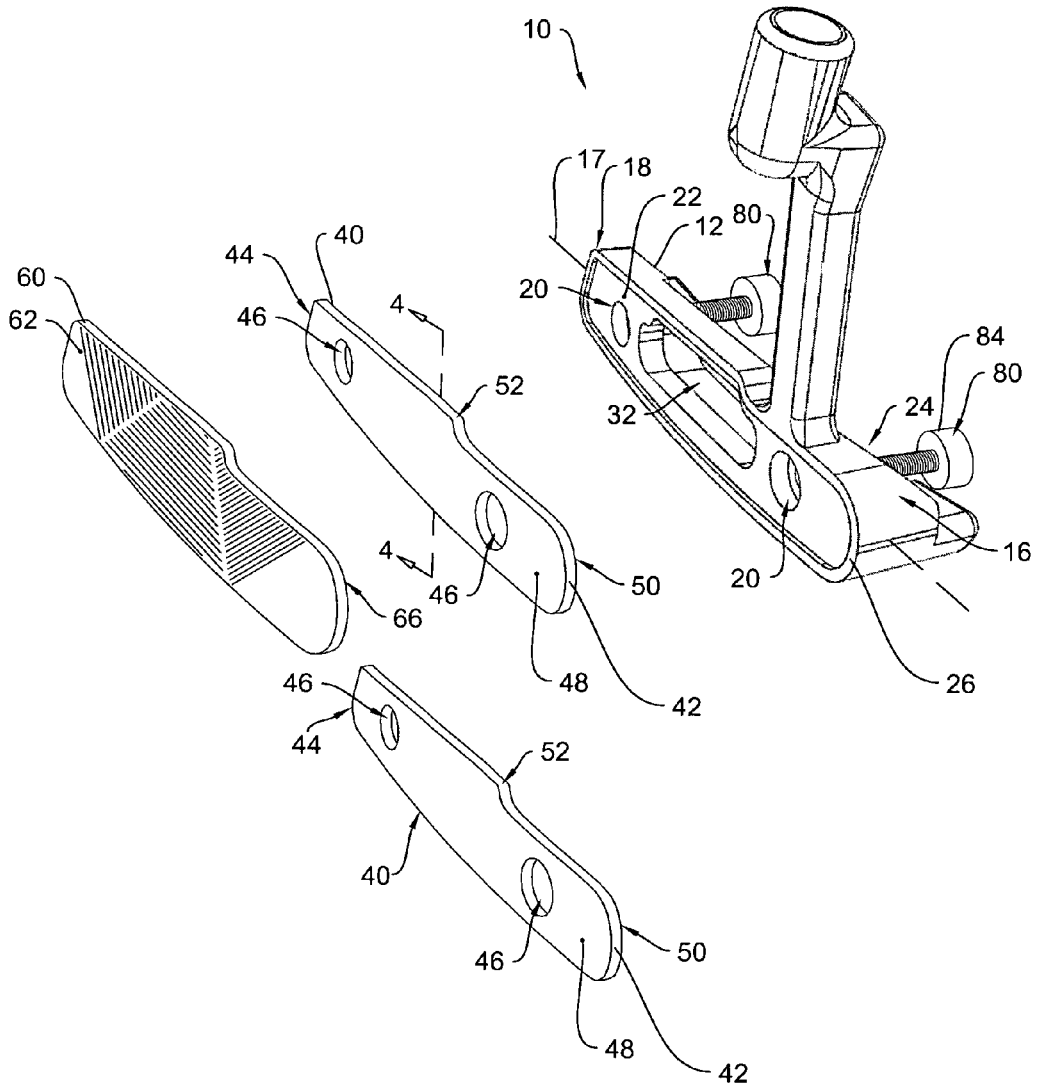
FIG. 2 is an exploded view of the putter head of FIG. 1.

Turning now to FIG. 2, an exploded view of the putter head is illustrated. The putter head body 12 comprises an elongate member having heal and toe portions 16 and 18, respectively and a longitudinal axis generally indicated at 17 extending therebetween. The heal and toe portions 16 and 18 each have a putter head body bore 20 extending therethrough. The putter head body 12 has a front surface 22 and a rear surface 24. The front surface 22 is substantially planar to receive the insert 40 thereon. The front surface 22 may also include a perimeter ridge 26 therearound for circumferentially surrounding the insert 40. The putter head body 12 may be formed of any material conventionally known, such as, for example, carbon steel. It will be appreciated that the putter may be formed of any known method, such as, for example, cast, machined, welded, or forged however it has been found that machining the putter head body 12 from a single block of material has been particularly useful.

Figure 4:
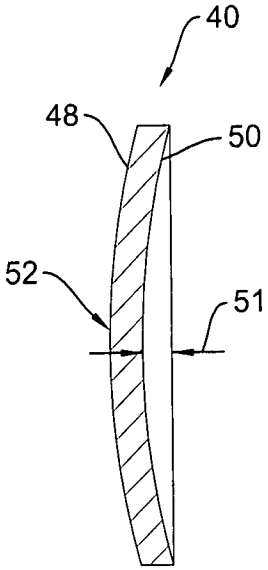
FIG. 4 is a cross sectional view of the insert of FIG. 1 taken along the line 4-4.

The insert 40 comprises a substantially planar member for adjusting the impact of the putter head 10 having front and rear surfaces, 48 and 50, respectively. The insert 40 has an outline corresponding to the outline of the putter head body 12 and includes heal and toe portions 42 and 44 each having an insert bore 46 therethrough. The insert bores 46 are positioned to be aligned with the putter head body bores 20 in the putter head body 12 when the insert is positioned against the front surface 22 of the putter head body. As illustrated in FIG. 4, the insert 40 may have a constant thickness between the front and rear surfaces 48 and 50 and may be domed such that a middle portion 52 of the insert is offset towards the front surface 48 by a distance generally indicated at 54. The offset distance 54 may be between 1.025 to 2.025 mm (0.040 to 0.080 inches).

The insert 40 may be formed of a variety of materials to adjust the reaction or "feel" of the putter head 10. In particular, as illustrated in FIG. 2, one of a plurality of inserts may be utilized to adjust the feel of the putter head as desired by the user. Materials may be selected for the insert to increase or decrease the roll or rebound effect imparted to the golf ball by the putter head or to adjust the reaction of the putter head to different playing surfaces. In particular, harder materials, such as, by way of non-limiting example, titanium, ceramics or steels may be utilized for slower greens. Softer materials may be utilized for faster greens, such as for example, brass, copper, carbon fibres or Kevlar. Intermediate or neutral materials, such as for example, carbon steel, nickel or tungsten may also be utilized for normal or intermediate greens. Although some exemplary material have been described above, it will be appreciated that other materials will also be useful as well. It will be appreciated that harder materials will amplify the impact of the putter head 10 upon a golf ball while softer materials will deaden the impact.

Figure 3:
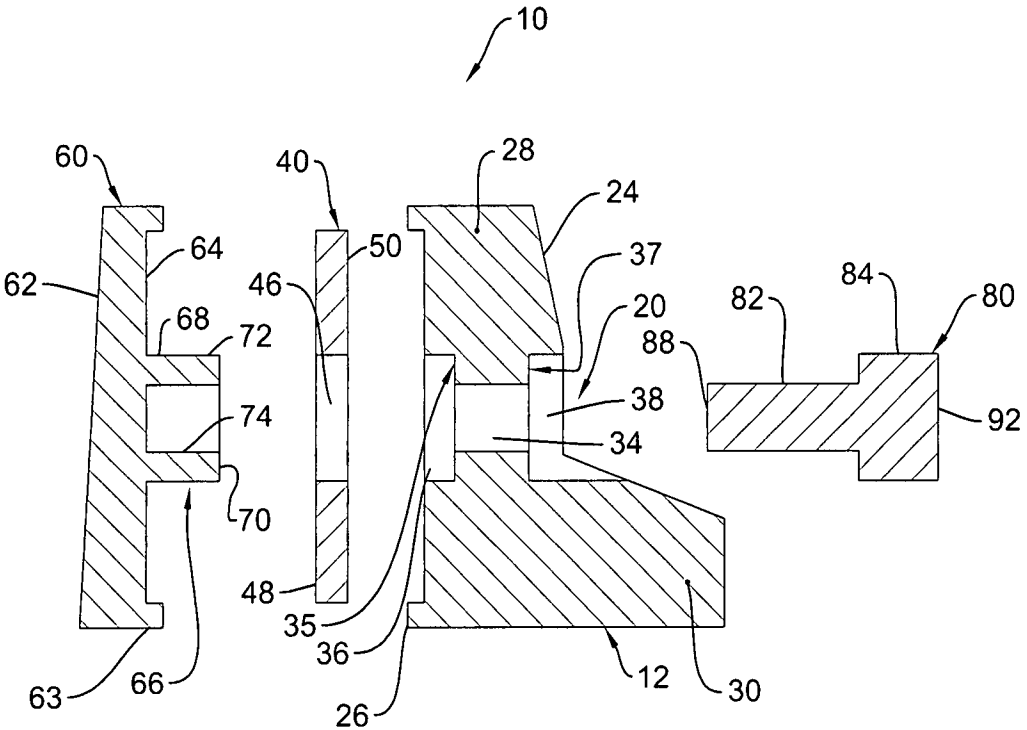
FIG. 3 is a cross sectional view of the putter head of FIG. 1 taken along the line 3-3
Figure 7:
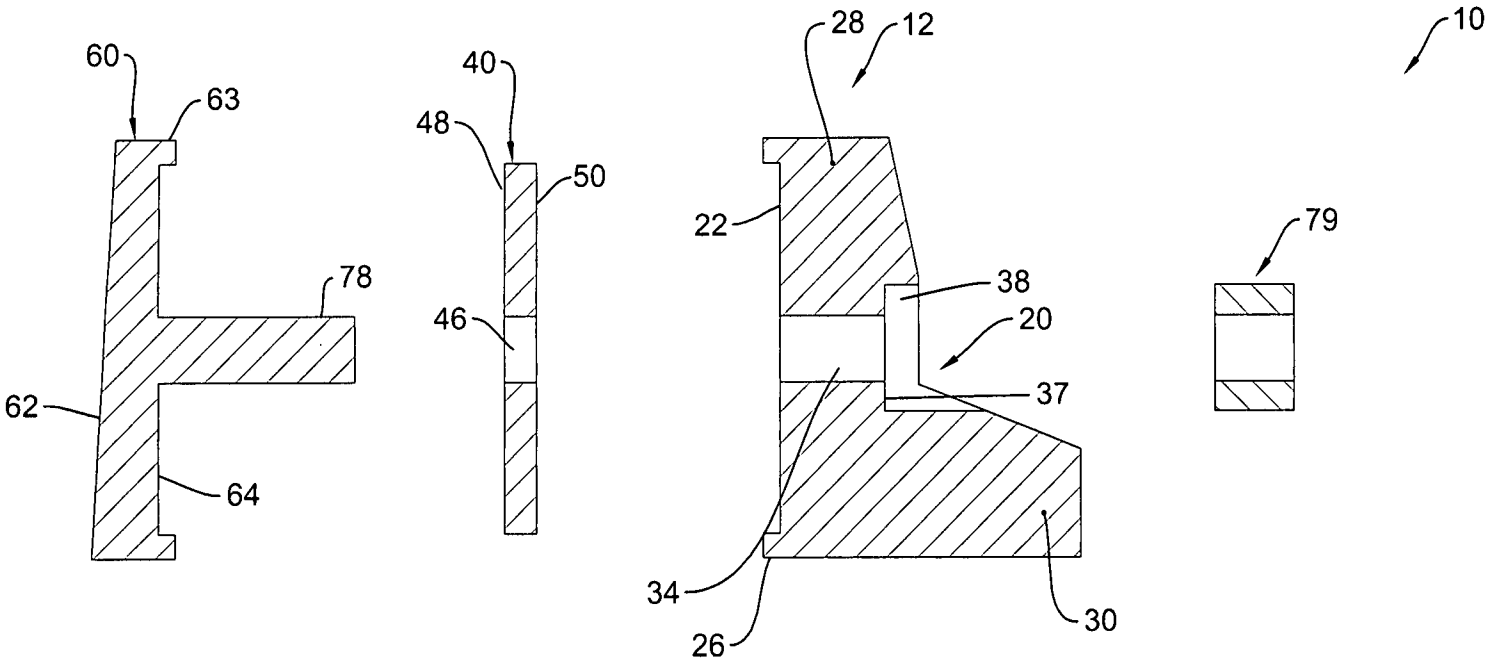
FIG. 7 is a cross sectional view of the putter head of FIG. 1 taken along the line 3-3 according to a further embodiment.

The putter face plate 60 comprises a substantially planar member having an outline substantially conforming to the outline of the front surface 22 of the putter head body 12. The putter face plate 60 has front and rear surfaces, 62 and 64, respectively, wherein the front surface 62 comprises a ball striking surface and wherein the rear surface may include a perimeter ridge 63 extending therearound for surrounding the insert 40 as illustrated in FIG. 3. The rear surface 64 includes at least one fastener receptacle 66 extending substantially perpendicularly therefrom for receiving the fasteners 80 as will be further described below. As illustrated, the fastener receptacle 66 may comprise a cylindrical projection 68 from the rear surface 64 of the putter face plate 60. The cylindrical projection 68 may have a distal end 70, an outer cylindrical surface 72 and an interior surface 74. The interior surface 74 may have interior threading corresponding to the threading on the fastener so as to permit the fastener and fastener receptacle to co-operate to retain the face plate and insert against the putter head body 12. In an alternate embodiment, as illustrated in FIG. 7, the putter face plate 60 may have a threaded post 78 extending therefrom through the insert bore 46 and the putter head body bore 20 wherein the putter head 10 includes a corresponding weighted nut 79 to be received thereon as will be described below with reference to weighted fasteners 80. The front surface 62 of the putter head face plate 60 may also have a loft as are commonly known of between 1.5 and 3.5 degrees although other lofts may be useful as well.

The fasteners 80 may comprise any known fastener type. In particular, the fasteners 80 may comprise screws having a threaded portion 82 having a distal end 88 and a head portion 84 having screw drive design 90 in a proximate surface 92 thereof. The threaded portion 82 will be sized so as to permit the fastener to extend through putter head body bores 20 and the insert bores 46 to be securely engaged within the fastener receptacles 66 of the putter face plate 60. The screw drive design 90 may be any conventional screw design to permit rapid interchangability or may also incorporate a unique design so as to require the use of a specialized tool or key to change the fasteners. The fastener 80 may be formed of any suitable material for forming such a fastener, such as, by way of non-limiting example, steel, brass, tungsten, titanium or an alloyed metal.

The head portion 84 will have a predetermined weight such that fasteners of differing weights may be utilized so as to adjust the swing characteristics of the putter head 10. In some embodiments, a plurality of fasteners 80 having a variety of head portions 84 of a variety of weights may be provided so as to permit the user to change the weights of the fasteners. The selection of particular weights of the fasteners will depend upon the other characteristics of the putter head although, by way of example, it has been found that fasteners having weights of 5, 8, 10 and 12.5 grams (0.18, 0.28, 0.35 and 0.44 oz). The use of fasteners 80 of different weight will adjust the center of mass of the putter head as well as the moment of inertia of the putter head 10. It will be appreciated that the placement of the putter head body bores 20 and the insert bores 46 will influence the amount of adjustability that the fasteners 80 has on the putter head 10. As illustrated, the putter head body bores 20 and the insert bores 46 are located within the heal and toe portions 16 and 18 of the putter head so as to maximize the influence of the fastener mass on the swing characteristics of the putter head. It will be appreciated that other placements of the fasteners and bores may also be utilized such as, for example, utilizing a single weight in one of the heal or toe portion or utilizing more than two fasteners for greater variety of adjustability of the swing characteristics of the putter head. The fastener When the putter head 10 is assembled, the middle portion 52 of the insert will bear against the putter face plate 60. The fasteners 80 will be passed through the putter head body bores 20 and the insert bores 46 to be received within the fastener receptacles 66 of the putter face plate 60. Up tightening the fasteners, the putter face plate 60 will be drawn towards the putter head body so as to bear against the insert which then bears against the front surface 22 of the putter head body 12. The insert 40 will deform when the putter head 10 impacts the ball due to the middle portion 52 contacting the putter face plate 60. The middle portion 52 of the insert will correspond with the sweat spot of the putter head. The ridge 26 of the putter head body 12 and the ridge 63 of the face plate circumferentially surround the insert 40. In some embodiments, the two ridges may abut against each other such that the insert 40 is not visible while in other embodiments, the two ridges 26 and 63 may have a gap between them such that the insert is visible therebetween.

Turning to FIG. 3, an exploded cross sectional view of the putter head 10 is illustrated through fasteners 80. As illustrated, the putter head body bore 20 may have a narrowed central passage 34 and widened front and rear portions 36 and 38, respectively with corresponding shoulders 35 and 37 therebetween. The front portion 36 may be sized to receive the fastener receptacle while the rear portion 38 will receive the weighted head portion 84 of the fastener 80.

Figure 5:
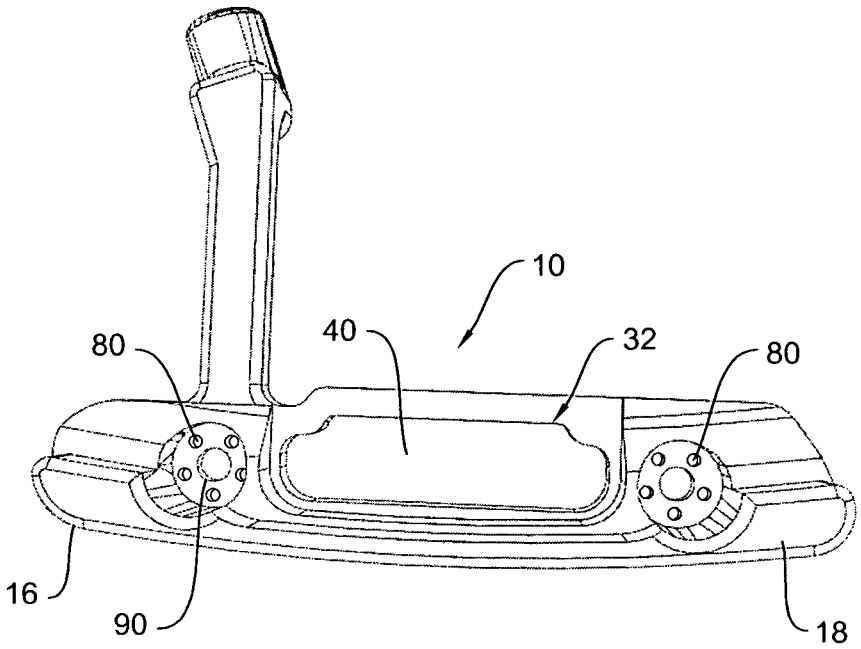
FIG. 5 is a rear perspective view of the putter head of FIG. 1.

The putter head body 12 may, in some embodiments include an upright portion 28 and a rear bottom flange 30 extending therefrom. It will be appreciated that the rear bottom flange 30 may also be omitted from some embodiments so as to form a blade putter. It will also be appreciated that the rear bottom flange 30 may have the shape of a portion of a horizontal disk so as to form a mallet type putter or have a substantially rectangular plate having greater thickness proximate to the heal and toe portions 16 and 18 so as to form a peripheral weighted putter as illustrated in FIG. 5. It will be appreciated that other shapes of the upright portion 28 and rear bottom flange 30 may also be utilized as are known in the art. As illustrated in FIG. 2, upright portion 28 of the putter head body 12 may include a cavity 32 therein. The cavity 32 may optionally comprise a void region passing through the upright portion 28 substantially behind the middle portion 52 or sweet spot of the putter face plate 60. It will be appreciated that the cavity 32 may also comprise a hollowed portion in the front surface 22 of the putter head body. The cavity 32 is provided to keep the middle portion 52 of the insert 40 to flex under impact with a ball.

Figure 6:
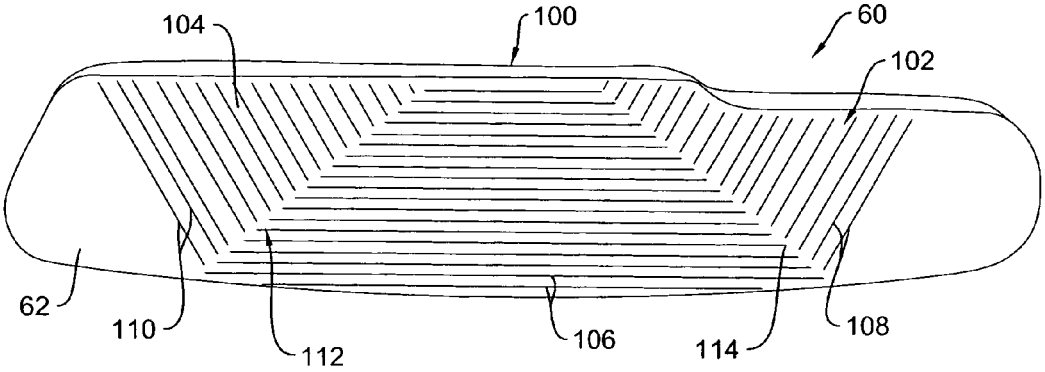
FIG. 6 is a front view of the face plate of the putter head of FIG. 1 showing a surface pattern according to a first embodiment.

Turning now to FIG. 6, a surface design on the front surface 62 of a putter face plate 60 is illustrated having a middle portion 100 and heal and toe portions 102 and 104, respectively. The middle portion 100 may have a plurality of parallel substantially horizontal grooves 106 milled or otherwise formed therein. The horizontal grooves 106 may have a depth of between 0.8 and 2.8 mm (0.031 and 0.110 inches) and may be spaced apart from each other by a distance of 1.5 and 2.25 mm (0.059 and 0.089 inches). The heal and toe portions 102 and 104 also have a plurality of parallel heal and toe grooves 108 and 110, respectively. The grooves of the heal and toe portions 108 and 110 may have a depth of between 0.5 and 0.8 mm (0.020 and 0.031 inches) and may be spaced apart from each other by a distance of between 1 and 2.5 mm (0.040 to 0.098 inches) although it will be appreciated that other spacing distances may also be useful as well depending upon the grove shape and depth. The heal and toe grooves 108 and 110 may be angularly oriented away from the middle portion 100 as illustrated in FIG. 6 by an angle of between 60 and 80 degrees from the horizontal.

The heal and toe portions 102 and 104 are separated from the middle portion 100 by heal and toe boundaries 112 and 114, respectively. The heal and toe boundaries 112 and 114 may comprise substantially straight lines angularly oriented towards each other at their top end. The heal and toe boundaries 112 and 114 may be angled from the horizontal at an angle of between 60 and 80 degrees. In some embodiments, the heal and toe grooves 108 and 110 may be angularly oriented and spaced apart such that the heal and toe grooves 108 and 110 align with the horizontal grooves 106 of the middle portion 100. The horizontal grooves 106 of the middle portion 100 assist to impart a forward or "true" roll to the ball with limited bounce or skipping of the ball upon being struck by the putter head 10. The heal and toe grooves 108 and 110 will assist in pushing off center or "miss hits" back towards center.

While specific embodiments of the invention have been described and illustrated, such embodiments should be considered illustrative of the invention only and not as limiting the invention as construed in accordance with the accompanying claims.

What is claimed is:

1. A putter head comprising:

a putter head body having a putter shaft connector and least one horizontal bore extending completely through said putter head body;

at least one of a plurality of interchangeable impact adjustment bodies an impact adjustment body locatable adjacent to said putter head body, said at least one of said plurality of interchangeable impact adjustment bodies impact adjustment body having at least one impact adjustment body bore alignable with said at least one putter head body bore;

a putter face plate locatable adjacent to said at least one of said plurality of interchangeable impact adjustment bodies impact adjustment body such that said at least one of said plurality of interchangeable impact adjustment bodies impact adjustment body is disposed between said putter face plate and said putter head body wherein said putter face plate is formed of a different homogeneous material than said plurality of interchangeable impact adjustment bodies; and at least one weighted fastener sized to extend through said putter head body bore and said impact adjustment body bore and to engage with said putter face plate so as to secure said putter face plate to said putter head body, wherein said at least one of said plurality of interchangeable impact adjustment bodies impact adjustment body comprises a planar member having an outline corresponding to said putter face plate, wherein said at least one of said plurality of impact adjustment bodies impact adjustment body is domed such that a middle portion of the insert is offset towards said putter face plate.

2. The putter head of claim 1 wherein said putter face plate includes at least one fastener receptacle alignable with said at least one impact adjustment body bore and said at least one putter head body bore wherein said at least one weighted fastener is engageable within said fastener receptacle to secure said at least one of said plurality of interchangeable impact adjustment bodies impact adjustment body and said putter face plate to said putter head body.

3. The putter head of claim 1 wherein said putter face plate includes at least one post extending therefrom, said post sized to extend through said putter head body bore and said impact adjustment body bore wherein said fastener is securable to an end of said post.

4. The putter head of claim 1 wherein said putter head body comprises a heal portion and a toe portion and a longitudinal length extending therebetween, wherein said heal portion includes a first putter head body bore and said toe portion includes a second parallel putter head body bore.

5. The putter head of claim 1 wherein said at least one of said plurality of interchangeable impact adjustment bodies impact adjustment body comprises a planar member having an outline corresponding to said putter face plate.

6. The putter head of claim 5 wherein said at least one of said plurality of interchangeable impact adjustment bodies impact adjustment body is domed towards said putter face plate.

7. The putter head of claim 1 wherein said at least one fastener has a weighted head having one of a plurality of predetermined weights.

8. The putter head of claim 1 wherein said putter face plate includes a ball striking surface.

9. The putter head of claim 8 wherein said ball striking surface is substantially planar.

10. The putter head of claim 9 wherein said ball striking surface is substantially perpendicular to said putter body bores and said impact adjustment body bores.

11. The putter head of claim 8 wherein said ball striking surface has a surface pattern therein.

12. The putter head of claim 11 wherein said pattern includes a first surface pattern and a second surface pattern.

13. The putter head of claim 12 wherein said ball striking surface includes said first surface patter across a central portion thereof and said second surface patters adjacent to heal and said toe portions.

14. The putter head of claim 12 wherein said first surface pattern comprises a plurality of parallel substantially horizontal grooves.

15. The putter head of claim 13 wherein said second surface pattern comprise a plurality of parallel grooves angularly extending from central portion upwardly towards said respective heal or toe portion.

16. The putter head of claim 15 wherein said angular groves of said second surface pattern are inclined at an angle of between 60 and 80 degrees from horizontal.

17. The putter head of claim 12 wherein said first surface pattern comprises a plurality of parallel substantially horizontal slots through said putter face plate.

18. A putter having the putter head of claim 1.

19. A kit for constructing an adjustable putter head comprising:

a putter head body having at putter shaft connector and least one horizontal bore extending completely through said putter head body;

a plurality of interchangeable impact adjustment bodies locatable adjacent to said putter head body, each of said plurality of impact adjustment bodies having at least one impact adjustment body bore alignable with said at least one putter head body bore;

a putter face plate locatable adjacent to said at least one of said plurality of interchangeable impact adjustment bodies impact adjustment body such that said at least one of said plurality of interchangeable impact adjustment bodies impact adjustment body is disposed between said putter face plate and said putter head body wherein said putter face plate is formed of a different homogeneous material than said plurality of interchangeable impact adjustment bodies; and a plurality of weighted fasteners sized to extend through said at least one putter head body bore and said at least one impact adjustment body bore and to engage with said putter face plate so as to secure said impact adjustment body and said putter face plate to said putter head body, said plurality of weighted fasteners having unique predetermined masses for adjusting the swing characteristics of said putter head, wherein said at least one of said plurality of interchangeable impact adjustment bodies impact adjustment body comprises a planar member having an outline corresponding to said putter face plate, wherein said at least one of said plurality of impact adjustment bodies impact adjustment body is domed such that a middle portion of the insert is offset towards said putter face plate.

* * * * *